United States Patent [19]

Jarvis et al.

[11] 4,010,324

[45] Mar. 1, 1977

[54] BACKGROUND NOISEMASKING SYSTEM

[76] Inventors: John P. Jarvis, 19120 Nordhoff St., Northridge, Calif. 91324; Ludwig W. Sepmeyer, 1862 Comstock Ave., Los Angeles, Calif. 90025

[22] Filed: Apr. 12, 1976

[21] Appl. No.: 675,770

Related U.S. Application Data

[63] Continuation-in-part of Ser. No. 534,214, Dec. 19, 1974, Pat. No. 3,980,827.

[52] U.S. Cl. ..... 179/1 P

[51] Int. Cl.[2] ..... H04R 3/00

[58] Field of Search ..... 179/1 AA, 1 P, 1 AT, 179/1 G, 1 GA, 1 E, 15.55 T

[56] References Cited

UNITED STATES PATENTS

| | | | |
|---|---|---|---|
| 3,272,198 | 9/1966 | Balkin | 179/1 AA |
| 3,567,863 | 3/1971 | Morissey | 179/1 AA |

*Primary Examiner*—Kathleen H. Claffy
*Assistant Examiner*—E. S. Kemeny
*Attorney, Agent, or Firm*—Allan M. Shapiro

[57] ABSTRACT

Noisemasking speakers are positioned in an array to direct noise into a space which is to be used by a number of people so that individual privacy is assured. The array is divided into four or more sets of speakers. The single noise source is equalized, and the same equalized noise is fed to the four speaker sets through time-delay devices so that the noise from each set has low correlation with each of the other sets.

10 Claims, 3 Drawing Figures

BACKGROUND NOISEMASKING SYSTEM

CROSS-REFERENCE

This application is a continuation-in-part of our U.S. patent application Ser. No. 534,214, now U.S. Pat. No. 3,980,827, filed Dec. 19, 1974 and directed to our "Diversity System for Noisemasking," the entire disclosure of which is incorporated herein by this reference.

BACKGROUND OF THE INVENTION

1. Field of the Invention

This invention is directed to a background noisemasking system which employs a single noise generator and equalizer in connection with a plurality of time delays to feed an equalized noise signal to different speaker arrays with different time delays.

2. Description of the Prior Art

Designers of large office operations have abandoned the practice of placing each desk in its own small room. Instead, today's office arrangement concept is to provide spacious open floors which are shared by many desks. The new concept, when employed to its greatest advantage, affords better efficiency and an informal atmosphere; however it is desirable to retain one property which is automatically provided by small or individual offices. This property is the privacy of conversation. The conversation may be with another worker or on the telephone. The protection of each worker from the distracting intrusion of noises from adjacent sources, such as conversations, business machines, and telephone ringing is a critical factor detrimental to this design. The open plan concept has gone beyond the office and is finding acceptance in hospital patient rooms. The specific details of the problem differ from the office requirements, but the basic goal is the same. In the hospital ward, each patient should be isolated from the sounds of the other patients, their conversations, and TV sets. In schools, the problem is more difficult because one large room may be shared by several classes of students. Each class must be acoustically coupled within itself, but each class must be acoustically separated from the adjacent one.

The use of sound-absorbing acoustical material is a basic element in the design of such spaces. Use of carpeting and wall and ceiling acoustical surfaces is common. In addition, panels and sound barriers are individually arranged to aid in the separation of spaces; however these measures cannot provide an adequate solution.

Most of the open-spaced offices are defined above by a ceiling, and above the ceiling is a plenum in which the offices services are channeled. Sprinkler piping, water piping, air-conducting duct work, electrical conduits, and the like are routed through the plenum space.

The prior art provides background masking noise, but the noise must be uniformly distributed through the space in order to achieve the satisfactory end results. If the noise is not uniform, masking is ineffective in one area, and a person walking through the room would be subjected to different intensities of background noise and thus would become conscious of it. The prior art systems mostly utilize commercial sound system components and then use sound contractors to install the loudspeakers in the plenum space above the open plan office ceilings. The plenum space above the ceilings is usually cluttered with air-conditioning ducts and electrical conduits. The speakers are positioned so that the plenum space is utilized as a mixing chamber for the background noise and, in theory, the noise filters down uniformly through the ceiling and into the office space; however this is only potentially true when the plenum is unobstructed and acoustically hard. The insulated air-conditioning ducts and the other equipment in the plenum interfere with this distribution and thus the plenum does not act as the theoretically uniform mixing chamber. Now, individualized positioning of the speakers by field acoustic technicians is required in order that the masking sound be uniform in the office space below.

The invention described above in the cross-reference is directed to the use of two independent noise sources feeding two sets of loudspeakers in an array, together with a third channel which is derived as the sum or difference of the two independent noise sources. The psycho-acoustic result of this arrangement is that a person exposed to the sound field produced by this arrangement feels immersed in a sea of sound. This is also the desired result of the present system wherein the result is accomplished in another way.

SUMMARY OF THE INVENTION

In order to aid in the understanding of this invention, it can be stated in essentially summary form that it is directed to a background noisemaking system wherein four equalized noise channels are produced by a single noise generator and a single equalizer followed by time-delay devices which delay the equalized signals by different time delays to different arrays.

Accordingly, it is an object of this invention to provide an economic background noisemasking system which includes only a single equalizer which is coupled to several time delays to provide equalized noise output into a plurality of channels. It is another object to provide an equalized noise system which is divided into a plurality of channels by employing a plurality of time delays to produce a plurality of channels, each with the same noise, but each with low correlation to the other. It is a further object of this invention to provide a system of loudspeakers arranged in lines and rows and directed into a workspace with the speakers arranged in four sets in such order that, in any arrangement of four speakers, there is only one speaker of each set.

The features of the present invention which are believed to be novel are set forth with particularity in the appended claims. The present invention, both as to its organization and manner of operation, together with further objects and advantages, thereof, may be understood best by reference to the following description taken in connection with the accompanying drawings.

DESCRIPTION OF THE PREFERRED EMBODIMENT

The system defined in the cross-referenced application requires two noise generators, two fractional octave band equalizers, and three amplifiers. For a sufficiently large system, power amplifiers do not constitute a significant economic factor. The most significant cost factor is in the fractional octave band equalizer. In accordance with the present invention, it is possible to achieve any specified degree of independence (lack of correlation) between the sound arriving at any one point from any two particular loudspeakers by introducing a time delay in the electrical signal feeding one of them. With an appropriate time delay $t$, the autocorrelation coefficient between the sound from each of the speakers is reduced to a sufficiently low level. It has been found that the valve of the correlation coefficient R is given by the equation:

$$R = \frac{\text{Sin}\,(X)}{X} \cdot \cos \frac{2f_0 X}{f}$$

where $X = \pi \Delta f t$ and $\Delta f$ is the measurement filter fractional octave bandwidth having a midband frequency $f_o$. When X has a value near $3\pi/2$, R lies between $\pm$ 0.212. By increasing $t$ so $X$ is nearly $5\pi/2$, $R$ is between $\pm$ 0.127. The envelope of $R$ lies within the boundaries of $\pm$ Sin $t/X$.

Figure 1:
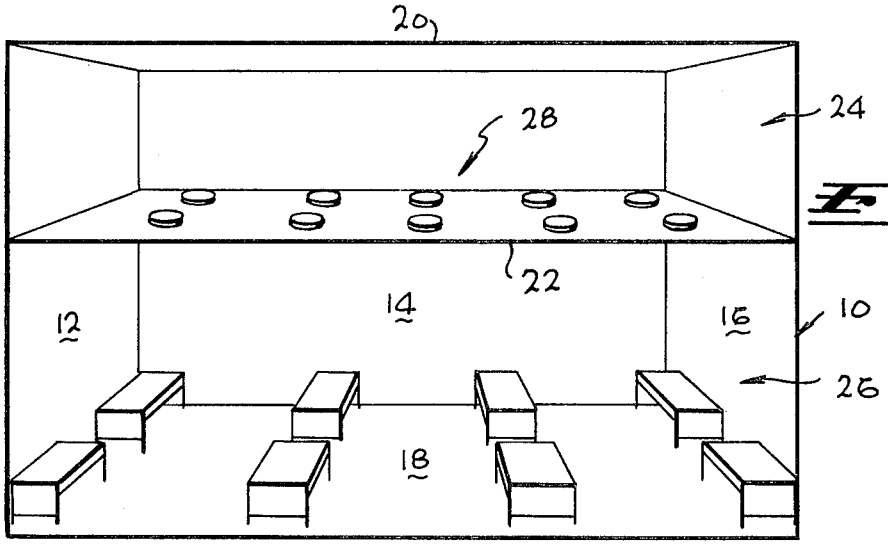
FIG. 1 is a perspective view of a space, and particularly an office space with the near wall broken away so that the interior arrangement of the space and the positioning of the speakers directed into the workspace thereof is illustrated.

This is achieved in a real system, as illustrated in FIG. 1, where the room or other workspace 10 is defined by four walls (three of which are shown at 12, 14 and 16), floor 18, and roof 20. Suspended ceiling 22 divides room 10 into plenum 24 and office space 26 in the illustrated open-plan arrangement.

In order to achieve speech privacy in open-plan offices such as office space 26, several acoustical requirements must be met. The ceiling 22 should be as high as possible and be very highly absorptive, in order to minimize the sound energy reaching the unintended listener by way of the ceiling-reflected path. Furthermore, absorptive surfaces preferably should be employed on the walls and the floors. Background masking noise is employed to mask the speech sounds which do reach the unintended listeners. In order to be as unobjectionable as possible and to maximize the masking, the background noise must have a smooth frequency characteristic and be completely random. For maximum masking efficiency, the spectrum shape of the background noise should conform to the spectrum shape of speech. Additionally, the background masking sound system should provide a substantially uniform amplitude characteristic throughout the entire office space 26 so that, as a person walks through the office space, he is not made conscious of the background masking sounds, as he would be if the perceived amplitude of the sounds were substantially different as a function of frequency in different locations.

Figure 2:
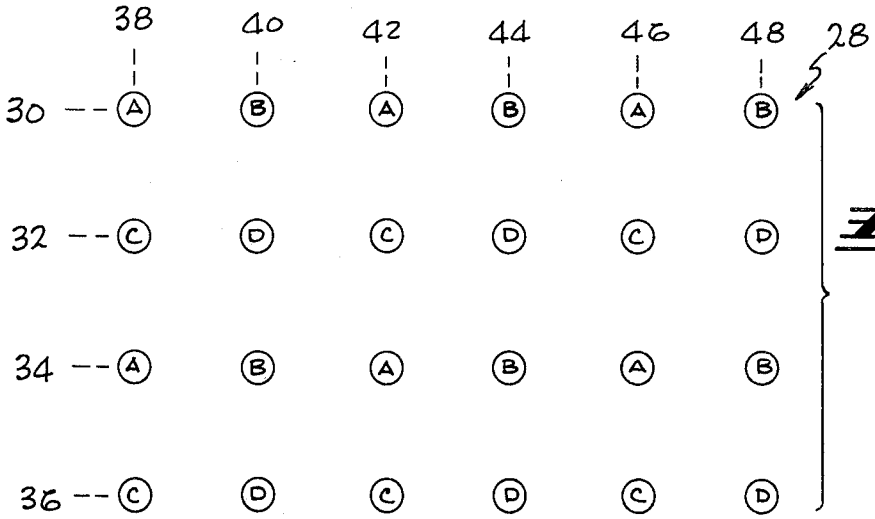
FIG. 2 is a diagrammatic illustration of the arrangement of the four sets of speakers into the speaker array which directs background masking noise into the workspace.

Speaker array 28 is shown as installed on the top of the suspending ceiling in FIG. 1, with the speakers directed downward, and is shown in projected arrangement in FIG. 2. Speaker array 28 is arranged in a plurality of rows such as, for example, rows 30, 32, 34 and 36 and in a plurality of lines such as, for example, lines 38, 40, 42, 44, 46 and 48. The lines and rows are preferably rectangularly arranged, and it has been found that a normal 8 to 10 foot center-to-center arrangement of rows and lines is practical.

In the prior art, it has been found that, with a single electrical noise source supplying loudspeakers in a regularly spaced loudspeaker array, rather severe and unpleasant peaks and dips of sound intensity occur. This is due to the interference effect of adjacent speakers in which path length differences from the several loudspeakers algebraically add and subtract. As a result, when one moves his head just a few inches, the character of the masking noise noticeably changes and makes the masking noise psychologically unacceptable. By placing four speaker sets powered with different time delays in the speaker array, this objectionable result can be overcome.

As is seen in FIG. 2, the four different speaker sets are arranged in array 28 and are identified by the letters A, B, C and D. In row 30, speakers of sets A and B alternate, while in row 32, speakers of sets C and D alternate. Row 34 is the same as row 30, while row 36 is the same as row 32. These speakers are illustrated as being arranged in squares, although they may be arranged other ways. The number of lines and rows can be arranged diagonally in the room, but the distance between the lines and rows is preferably equal so as to place speakers at the corners of squares. There is a sufficient number of rows and lines, as required by the dimensions of the room. Thus, the speaker array extends over the entire room to distribute masking noise over the entire room. The individual speakers are preferably mounted directly on the suspended ceiling and are directed downward to project the sound into the workspace 26 portion of the room.

While it is possible to supply each speaker with its own individual noise source, such requires an excessively large number of noise sources, equalization networks, and amplifiers. The acoustic power level of the masking noise in the office area or any other area covered by the system, as measured at various specific frequencies within the audio-frequency band, is desirably controlled so that it substantially follows a prescribed curve. The shape of this curve represents the average of male and female speech or typical conversational speech effort, with some modification at low frequencies in order to take into account air-conditioning and traffic noises. The equipment required to accomplish this equalizing independently for each speaker would be very expensive.

Figure 3:
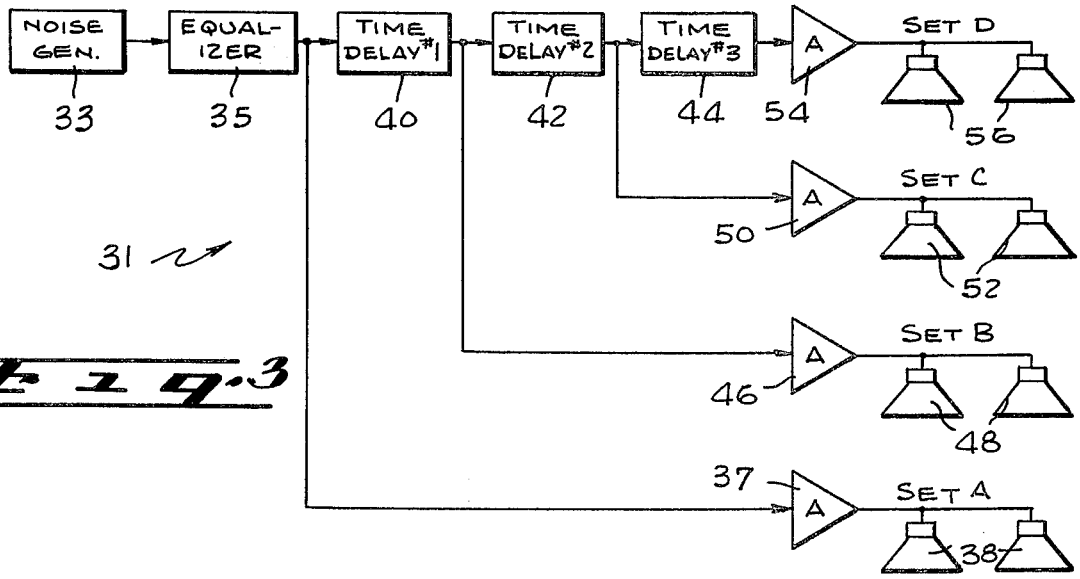
FIG. 3 is a block diagram of the system which provides time-delayed noise signals to the four speaker sets.

FIG. 3 is a schematic diagram of the component of the background noisemasking system. The equipment which produces the correctly formed and balanced noise for this system is generally indicated at 31 in FIG. 3. The noise is originated in noise generator 33 which produces random or "white" noise which has the same power over the entire audio-frequency band. This type of noise has a power curve drastically different from the desired curve, particularly in that the high frequency components produce a sound that resembles the release of high-pressure steam. Noise generator 33 can be any random noise generator, and for convenience and economy, it preferably is a simple white noise generator such as the amplified junction noise in a transistor. Noise generator 33 preferably includes a preamplifier. Equalizer 35 is connected to the output of noise generator 33. If there is no amplifier in noise generator 33, then there is an amplifier in the input to equalizer 35. The amplifier may not be flat in its frequency response, in order to provide some preliminary adjustment on the equalization. Equalizer 35 is a narrow band equalizer. It has individually adjustable fractional octave bands from 90 hertz to 4 kilohertz. The output of the equalizer has a noise spectrum such that the resulting noise field in the workspace has the desired energy distribution with respect to speech and other audio in the area.

The output of equalizer 35 powers amplifier 37 which, in turn, powers loudspeakers 38 of set A. The output of equalizer 35 also supplies the equalized noise signal to time delay No. 1 indicated at 40 of FIG. 3. Time delay No. 1, as well as serially connected time delays 2 and 3 indicated at 42 and 44, is a modern integrated circuit time-delay device of preselected or adjustable delay characteristics which may be of the digital or analog type. For example, one such device is available from Reticon Corporation, of Sunnyvale, California, under catalog designation SAD-1024. The output of time delay device 40 is connected to amplifier 46 which feeds the speakers 48 in set B. The output of time delay device 42 feeds amplifier 50 which feeds the speakers 52 of set C. The output of time delay device 44 feeds amplifier 54 which powers the speakers 56 of set D. Thus, the signal to each of the sets of speakers is delayed with respect to the other sets. The output of the four adjacent speakers must be sufficiently uncorrelated as discussed above.

FIG. 3 shows set A's loudspeakers 38 are fed directly from the equalized noise source. Set B speakers 48 signals are delayed by an amount $t$. Set C speakers 52 signals are delayed by approximately 2 $t$, and set D speakers 56 are delayed by approximately 3 $t$. Clearly, if one were standing directly under a B loudspeaker and $t$ were just equal to the difference in travel time between the travel paths, the two sounds would be exactly in phase. Hence, $t$ must be greater than the time it takes sound to travel the average array spacing. It is preferred that $t$ be approximately equal to 1.5 times the average array spacing travel time. By not making the delay between B and C and C and D exactly equal, a point of equal correlation among the four different sources will be avoided.

This is a first order system for minimizing the correlation of sound between sets of speakers in an array of loudspeakers. This system requires one noise source, one narrow band equalizer, and three time delay devices of appropriate delay characteristics. This system requires four power amplifiers to feed four sets of speakers arranged in arrays of two-by-two. A further degree of sophistication could require more sets of speakers, with each speaker set having its own power amplifier. These amplifiers would be fed from a single noise source through a single equalizer and through time delays. These more sophisticated array arrangements would offer some improvement over the first order system, but would be of lower cost effectiveness if the cost associated with the greater complexity would be greater than the improvement in the noisemasking system.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A system for noisemasking having a noise generation and masking system comprising of:

a single noise generator for producing random noise;

a single equalizer connected to the output of said noise generator for producing electronic noise signals equivalent to equalized non-delayed audio noise in a first channel; and means connected to said first channel for receiving the equalized audio noise electronic signal and for introducing a first time delay therein to produce a second channel and for introducing a second time delay therein for producing a third channel of equalized audio noise electronic signals, each channel driving selected speakers of an array.

2. The noisemasking system of claim 1 wherein:

said time delay means further includes means for producing a third time delay to provide a fourth channel of equalized audio noise electronic signal.

3. The noisemasking system of claim 2 including:

first, second, third and fourth power amplifiers respectively connected to said first, second, third and fourth channels.

4. The noisemasking system of claim 3 including:

an array of speakers positioned to direct masking noise into workspace, said first, second, third and fourth power amplifiers each being connected to selected ones of said speakers in said array.

5. The noisemasking system of claim 4 wherein:

said array includes first, second, third and fourth sets of speakers arranged in rows, one of said rows of speakers alternately containing speakers in two of said sets and alternate ones of said rows containing speakers in the other two sets, said speakers being arranged in said rows to form lines of speakers so that along any row and along any line, adjacent speakers belong to different sets.

6. A noisemasking signal system comprising:

a loudspeaker array positioned to provide masking noise into a space, said loudspeaker array comprising first, second, third and fourth sets of speakers;

a single noise generator, a single equalizer connected to said noise generator to produce a first channel carrying electric signals corresponding to equalized audio frequency noise; and means connected to said first channel for time delaying the electrical signal in said first channel for producing second, third, and fourth channels of equalized audio frequency electrical signals, said first, second, third and fourth equalized audio frequency electrical signals, said first, second, third and fourth equalized audio frequency electrical signals being respectively connected to said first, second, third and fourth sets of speakers.

7. The system of claim 6 wherein:

said sets of speakers are arranged in an array such that each speaker has only speakers of other sets adjacent thereto.

8. The system of claim 7 wherein:

said speaker array is arranged in rows and in lines with speakers of two sets being located in one row and the two speakers of the other sets being located in adjacent rows.

9. The system of claim 6 wherein:

said means for providing a time delay is a digital time delay device.

10. The system of claim 6 wherein:

said means for providing a time delay is an analog time delay device.

* * * * *